US005303846A

United States Patent [19]

Shannon

[11] Patent Number: 5,303,846

[45] Date of Patent: Apr. 19, 1994

[54] METHOD AND APPARATUS FOR GENERATING AND DISPENSING FLAVORING SYRUP IN A POST MIX SYSTEM

[75] Inventor: Joseph W. Shannon, Kent, Ohio

[73] Assignee: ABCC/TechCorp., Akron, Ohio

[21] Appl. No.: 583,159

[22] Filed: Sep. 17, 1990

[51] Int. Cl.[5] ..... B67D 5/08

[52] U.S. Cl. ..... 222/54; 222/66; 222/129.4

[58] Field of Search ..... 222/54, 64, 66, 67, 222/129.1, 129.2, 129.3, 129.4

[56] References Cited

U.S. PATENT DOCUMENTS

| | | | |
|---|---|---|---|
| 2,880,912 | 4/1959 | Fisher | 222/640 X |
| 3,804,297 | 4/1974 | Jurjans | 222/54 |
| 4,445,627 | 5/1984 | Horak | 222/54 |
| 4,487,333 | 12/1984 | Pounder et al. | 222/129.4 X |
| 4,728,005 | 3/1988 | Jacobs et al. | 222/64 |
| 4,753,370 | 6/1988 | Rudick | 222/129.1 X |
| 4,869,396 | 9/1989 | Horino et al. | 222/54 |

*Primary Examiner*—Andres Kashnikow
*Assistant Examiner*—J. A. Kaufman
*Attorney, Agent, or Firm*—Renner, Kenner, Greive, Bobak, Taylor & Weber

[57] ABSTRACT

A method and apparatus for generating a flavoring syrup within a soft drink dispenser are disclosed. Syrup generation tanks receive sugar and water and combine the two to create a saturated solution constituting a sweetening syrup. The sweetening syrup is passed to a dispensing head. A flavoring agent is also presented at the dispensing head, as is a supply of soda or carbonated water. Dispensing of the sweetening syrup, flavoring agent, and soda is controlled by valves associated with each of the ingredients. The brix of the sweetening syrup is determined as a function of the temperature of the sweetening syrup, such brix being determinative of the amount of sweetening syrup dispensed to assure a proper brix level of the resulting drink.

16 Claims, 1 Drawing Sheet

METHOD AND APPARATUS FOR GENERATING AND DISPENSING FLAVORING SYRUP IN A POST MIX SYSTEM

TECHNICAL FIELD

The invention herein resides in the art of soft drink dispensers and, more particularly, to a syrup generating system to be employed with such dispensers. Specifically, the invention relates to a method and apparatus for making sweetening and flavoring syrup at the site of the beverage dispenser.

BACKGROUND ART

It is well known that soft drinks typically comprise a soda or carbonated water base which is sweetened and flavored by an appropriate syrup. It is also well known that only a small portion of such syrups constitute flavoring, with the larger portion, often in excessive of 99 percent by volume, constituting a sweetening medium. Most syrups are nothing more than a combination of sugar and water or, at the very most, an appropriate sweetening agent and water. While so-called diet drinks do not employ a sugar base for the syrup, a sweetener is in fact combined with water and a flavoring agent to achieve the desired result.

It is further well known in the art that the shipping, handling, and storage costs incident to soft drink syrups constitute a major contributor to the cost of soft drinks. Indeed, the soda or carbonated water for soft drinks is typically generated on-site by entraining carbon dioxide in water under pressure. Accordingly, shipping, handling, and storage costs for the soda portion of the soft drink is minimized.

It is well known that only the flavoring component of the sweetening and flavoring syrup for soft drinks is proprietary and available only from limited sources. The remaining portions of the sweetening and flavoring syrup, sugar (or other sweetener) and water, are generally widely available, and are not of a proprietary nature. Accordingly, generation of syrup on-site in a beverage dispenser can greatly reduce the transportation, handling, and storage costs incident to that component of soft drinks.

DISCLOSURE OF INVENTION

In light of the foregoing, it is a first aspect of the invention to present a method and apparatus for generating syrup in a beverage dispensing apparatus in which the sweetening and flavoring syrup is generated within the dispensing system itself.

Another aspect of the invention is the provision of a method and apparatus for generating syrup in a beverage dispensing system which substantially eliminates the shipping, handling and storage costs previously incident to such syrup.

Yet another aspect of the invention is the provision of a method and apparatus for generating syrup in a beverage dispensing system in which the sweetness or brix of the syrup can be measured at the time of dispensing.

Another aspect of the invention is the provision of a method and apparatus for generating syrup in a beverage dispensing system in which the amount of syrup dispensed in a soft drink is a function of the brix of the syrup.

Still a further aspect of the invention is the provision of a method and apparatus for generating syrup in a beverage dispensing system in which a sweetening component of the syrup and a flavoring component of the syrup are combined in the dispensing system itself.

Still another aspect of the invention is the provision of a method and apparatus for generating syrup in a beverage dispensing system which is efficient and effective in operation, generally conducive to implementation with state of the art systems, and reliable and durable in use.

The foregoing and other aspects of the invention which will become apparent as the detailed description proceeds are achieved by a system for generating flavoring syrup in a soft drink dispenser, comprising: a source of sweetener; a source of water; first means connected to said sources of sweetener and water for receiving sweetener and water and generating a sweetening syrup therefrom; a source of flavoring; and second means interposed between said first means and said source of flavoring for combining said sweetening syrup and flavoring.

Other aspects of the invention which will become apparent herein are attained by a method for dispensing a soft drink, comprising the steps of: dispensing a sweetening syrup; dispensing a flavoring; dispensing carbonated water; and combining said sweetening syrup, flavoring, and carbonated water.

Yet other aspects of the invention which will become apparent herein are attained by a soft drink dispenser, comprising: a dispensing head; a source of carbonated water interconnected with said dispensing head; and means for generating flavoring syrup interconnected with said dispensing head.

DESCRIPTION OF DRAWING

For a complete understanding of the objects, techniques and structure of the invention reference should be made to the following detailed description and accompanying drawing wherein.

BEST MODE FOR CARRYING OUT THE INVENTION

Figure 1:
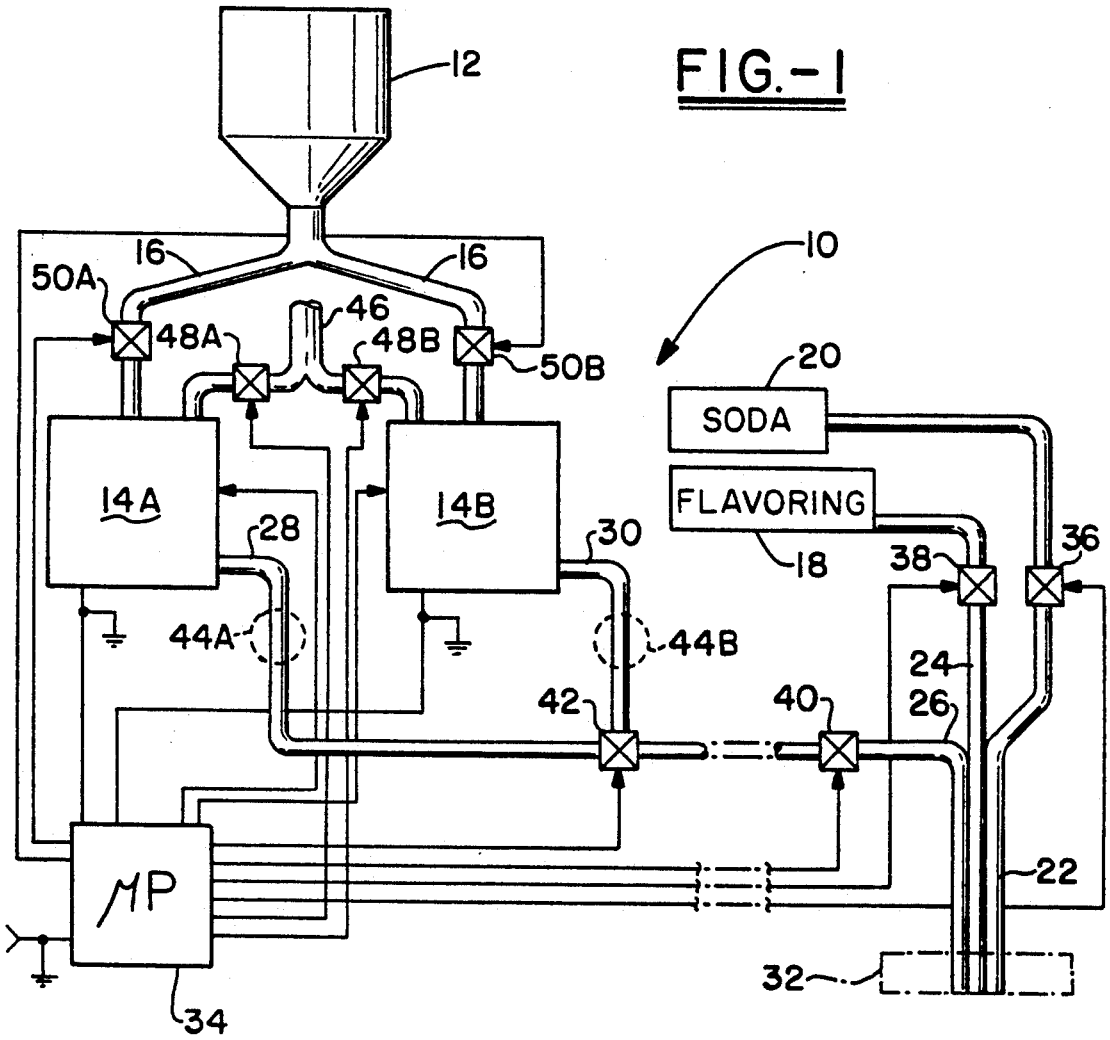
FIG. 1 is an illustrative view of a soft drink dispenser accordingly to the invention.

Referring now to the drawing and more particularly FIG. 1, it can been seen in a soft drink dispensing system according to the invention is designated generally by the numeral 10. A bin or other receptacle 12 is provided for receipt and maintenance of a bulk supply of sugar or other appropriate sweetening agent. The bin 12 communicates with a pair of syrup generation tanks 14A and 14B, adapted to generate, maintain, and dispense unflavored sweetening syrup. Feed lines 16 interconnect the bin 12 with the respective syrup generation tanks 14 as shown.

Also provided as a portion of the soft drink dispensing system 10 is a source of flavoring essence or flavoring agent 18. As will be appreciated by those skilled in the art, the flavoring essence or agent maintained at the source 18 is generally of a proprietary nature, being that component of a soft drink which provides the distinctive flavor and character of a specific brand. Typically, the essence or agent 18 is in a liquid form and readily capable of being dispensed using dispensing techniques presently known in the beverage dispensing art.

Also included as a portion of the system 10 is a source of soda 20. As will be appreciated by those skilled in the art, soda is typically carbonated water, with the source 20 typically including a source of carbon dioxide which is provided as a pressure head to a reservoir of water such that the carbon dioxide becomes entrained in the water to achieve the desired level of carbonation. Since such techniques and structure are presently well known in the art, they are not elaborated upon herein.

A plurality of lines or conduits are provided to allow the soda, flavoring agent, and sweetening syrup to be dispensed from their supply sources to a cup or other receptacle for the presentation of a soft drink. A soda line 22 communicates with the soda source 20, the flavoring agent line 24 communicates with the source of flavoring 18, and a syrup line 26 is interconnected at a junction with the lines 28, 30 respectively feeding from the syrup generation tanks 14A, 14B. As shown, the lines or conduits 22, 24, 26 join together at an appropriate dispensing head 32, shown in phantom in the drawing. The dispensing head 32 is maintained at an appropriate dispensing station and is so situated that an appropriate cup or the like may be placed under the head 32, a pour switch may be activated, and a full measure of selected beverage may be dispensed.

As part and parcel of the instant invention, a microprocessor 34 is provided to control the operation of the system 10 as, for example, by controlling the actuation of the soda dispensing valve 36 within the soda line 22, the flavoring agent dispensing valve 38 positioned within the flavoring line 24, and the syrup dispensing valve 40 positioned within the dispensing line 26. As will be readily appreciated by those skilled in the art, actuation of the various valves 36, 38, 40 for specific periods of time allow for the dispensing of desired quantities of soda, flavoring agent, and sweetening syrup during a dispensing cycle. The dispensed items are typically dispensed under a pressure head, although it will be understood that mechanical pumps or gravity feed may be employed within the concepts of the instant invention.

A valve 42 interconnects the output lines 28, 30 of the syrup generation tanks 14A, 14B with the syrup dispensing line 26. The valve 42, controlled by the microprocessor 34, is of the type to mutually exclusively interconnect one of the lines 28, 30 with the dispensing line 26 at any point in time. In other words, one and only one of the output lines 28, 30 can be connected to the dispensing line 26. Therefore, dispensing of sweetening syrup is obtained from one and only one of the tanks 14A, 14B at any given point in time. It will also be seen that pumps, shown in phantom and designated by the numerals 44A and 44B may be interposed within the output lines 28, 30 from the tanks 14A, 14B. As will be readily appreciated by those skilled in the art, the pumps 44A, 44B may be of the mechanical type, or may be pneumatically driven from a pressure head of carbon dioxide gas. Of course, the pumps are shown in phantom since the system 10 may simply be a gravity feed system, in which case no pumps may be necessary.

A water supply line 46 connects with any appropriate municipal source of water and "tees" to feed each of the tanks 14A, 14B through respective valves 48A, 48B. These valves, under control of the microprocessor 34, allow water from the water supply line 46 to enter the associated tank 14A, 14B upon actuation. It will also be seen that the feed lines 16 from the bin 12 have associated control valves 50A, 50B respectively affiliated with the tanks 14A, 14B. The valves 50A, 50B are also under control of the microprocessor 34 so as to be opened only when a demand for sugar is evidenced by an associated tank in a manner discussed below.

Figure 2:
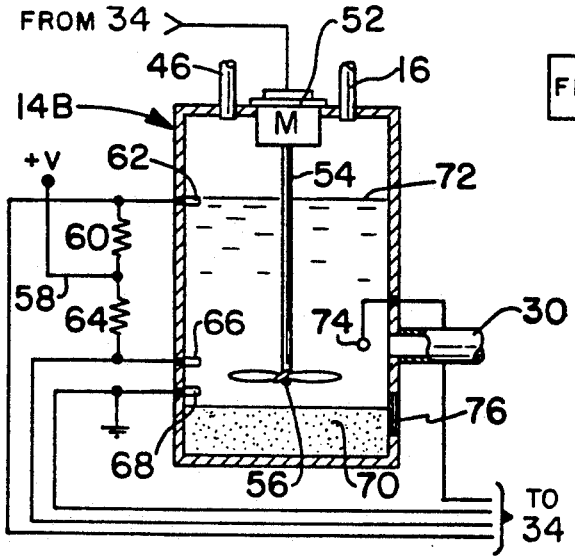
FIG. 2 is an illustrative sectional view of a syrup generation tank according to the invention.

The tanks 14A, 14B are substantially identical. A cross sectional view of the tank 14B is shown in FIG. 2, where it can be seen that a motor 52 is provided therein and under control of the microprocessor 34. A shaft 54 is connected to and extends from the motor 52 and has a propeller 56 at an end thereof within the tank 14B.

A voltage source 58 interconnects through a resistor 60 to a top level sensor 62, the sensor 62 being interconnected with the microprocessor 34. In like manner, the voltage source 58 also passes through the resistor 64 to a bottom level sensor 66 which is also connected to the microprocessor 34. Finally, a ground probe 68 provides an electrical ground reference between the sensors 62, 66 and the microprocessor 34.

As further shown in FIG. 2, sweetener or sugar, of solid or granular form, is typically maintained in the bottom of the tank 14B, while a solution of syrup is maintained thereabove, as designated at the full level by the numeral 72. Finally, a temperature sensor such as a thermocouple 74 or the like is positioned at the outlet of the tank 14B as at the outlet line 30. If desired, a window 76 may be provided near the bottom of the tank 14B to allow visual inspection to be certain that sugar is maintained at the bottom portion thereof.

With an appreciation of the structure of the invention as presented above, the operation of the apparatus and technique of the invention may now be discussed. It is known that sugar will dissolve in water and, if enough sugar is introduced into the water, a saturated solution will result. This saturated sugar water solution comprises a sweetening syrup which may be employed in the making of a soft drink. Of course, if the sugar is substituted with a dietary sweetener, the same type of saturated solution can be obtained. In any event, the resulting solution is simply one in which the water serves as a solvent and the sugar or sweetener serves as the solute.

It is further known that the amount of sugar or sweetener that water will hold in solution in a saturated state is a function of the temperature of the solution. For each temperature, there is a fixed amount of sugar that will enter into the solution. Since the brix of a syrup is simply the measure of its sweetness and is a function of the amount of sugar dissolved in the water, the temperature of the solution may be used as an indicator of the brix. Accordingly, the invention herein generates a saturated solution of sugar water or other appropriate sweetening syrup, determines the brix of that syrup by measuring the temperature thereof, and dispenses the appropriate amount of syrup for the right sweetness of the resulting drink, such dispensing being made substantially concurrent with the dispensing of a flavoring agent and the soda component.

The microprocessor 34 selects one of the tanks 14A or 14B for the tank from which sweetening syrup is to be dispensed, such selection being under control of the valve 42. Assume for purposes of discussion that dispensing is to be made from the tank 14B. On each dispensing cycle, a quantity of syrup is dispensed from the tank 14B through the line 30, pump 44B, and out of the line 26 during the period of time that the valve 40 is open. During that same dispensing cycle, or a portion thereof, the valve 38 is opened such that flavoring agent may be dispensed from the source 18 and through the line 24. In similar fashion, the valve 36 is actuated to allow soda to be dispensed from the source 20 and through the dispensing line 22. Mixing of the three components may occur within the receiving cup, or in the stream passing from the dispensing head 32 to the cup.

While there is sufficient sweetening syrup within the tank 14B to make contact with the bottom sensor 66, the output of the sensor 66 is at a ground level due to the electrical interconnection between the sensor 66 and ground probe 68 through the syrup media. However, as the dispensing cycles continue such that the syrup within the tank 14B falls below the bottom sensor 66, the voltage at the sensor 66 rises to the value V, indicating that the level of sweetening syrup within the tank 14B is at a low level and should be replenished. Upon sensing this condition, the microprocessor 34 switches the valve 42 such that dispensing of sweetening syrup will then be from the tank 14A, with the output line 30 of the tank 14B being closed. At this time, the valve 50B is opened such that sugar or other sweetener may pass from the bin 12, through the feeding line 16, and into the syrup generation tank 14B. The amount of sugar deposited will be enough to ensure saturation of water which is allowed to enter from the water supply line 46 through the valve 48B opened by the microprocessor 34. This water enters the tank 14B until the water level reaches the top sensor 62, at which time the voltage at the top sensor 34 goes from V to ground, since the water provides an electrical path between the sensor 62 and ground probe 68. At this point in time, the microprocessor 34, connected to the sensor 62, closes the valve 48B to terminate the fill cycle. The microprocessor 34 then actuates the motor 52 to rotate the propeller 56 to agitate the sugar and water within the tank 14B for a sufficient period of time to assure saturation of the solution. Periodically, the microprocessor 34 will again actuate the motor 32 to agitate the solution to assure that saturation is maintained. Of course, at any state of saturation there will be some residue of sugar 30 remaining in the bottom of the tank 14B as shown, such residue assuring saturation.

It will be appreciated that the thermocouple or temperature sensor 74 provides an indication to the microprocessor 34 as to the temperature of the syrup being dispensed. Since the temperature of the syrup is an indication of the brix or sugar concentration thereof, such temperature may be used as a means for determining the amount of sweetening syrup to be dispensed during a dispensing cycle to achieve a desired sweetness or brix level for the soft drink. Accordingly, this temperature may be used by the microprocessor 34 to control the sweetening syrup dispensing valve 40 to hold the same open for a period of time sufficient to assure that the desired amount of sugar has been dispensed via the sweetening syrup. The microprocessor 34 could, of course, also control the pumps 44A, 44B to regulate a pressure head or the like to similarly assure a proper disbursal. Additionally, the microprocessor 34 can also monitor the amount of sugar dispensed in emptying the syrup generation tank by simply tabulating the amount of sugar dispensed via the sweetening syrup on each dispensing cycle. With this information, the microprocessor 34 can determine how much sugar or other sweetener needs to be added to the syrup generation tank 14 via the associated valve 50 from the bin 12 during the refill cycle. Such monitoring will always assure sufficient sugar in the tank to attain and maintain saturation.

It will also be appreciated by those skilled in the art that the amount of flavoring agent to be dispensed from the source 18 is quite small in relation to the volume of sweetening syrup to be dispensed from the associated tank 14A, 14B. Accordingly, the inside diameters of the flavoring agent line 24 and the sweetening syrup line 26 can be appropriately scaled such that the line 26 have an inside diameter between 8 and 10 times the inside diameter of the line 24. In a preferred embodiment of the invention, the syrup line 26 may have an inside diameter on the order of ¼ inch, while the inside diameter of the line 24 would be on the order of 1/32 inch.

Figure 3:
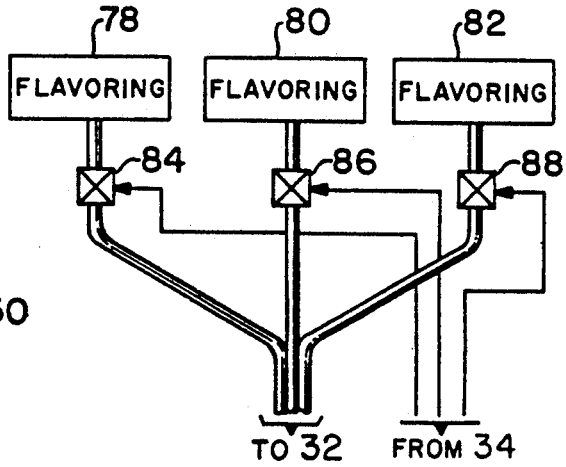
FIG. 3 is an illustrative view of the flavoring agent portion of an alternative embodiment of the invention, showing multiple sources of flavoring agents.

The basic concept of generating a sweetening syrup and combining the same with the flavoring agent has been presented above. With such concept being understood, it will be appreciated by those skilled in the art that the beverage dispensing system 10 may include a plurality of flavoring agent sources so as to be capable of dispensing soft drinks of various flavors or brand. To this end, there is shown in FIG. 3, additional flavoring agent sources 78, 80, 82, having respective conduits or dispensing lines associated therewith and adapted to be interposed within the dispensing head 32. Interposed within each of the dispensing lines is a respectively associated dispensing valve 84, 86, 88, all under control of the microprocessor 34 as discussed above.

Finally, it will be readily appreciated by those skilled in the art that the concept of the invention may be employed in a manual system as well as the automated system presented above. Indeed, a pair of tanks 14A, 14B may be employed as presented above, with the monitoring of levels being by visual observation rather than electronic sensing. Further, sugar or other sweetener may be added by hand as may the necessary water to complete the solution. Indeed, the concept of the invention may be achieved by any of various means and structures readily perceived in light of the foregoing description. Indeed, a single sweetening syrup generation tank may be employed, but two are preferred since one may be used for active dispensing while the other is being refilled and/or regenerated. In other words, while one of the tanks is dispensing, the other one can be developing a saturated solution of sugar and water or sweetening syrup.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A system for generating flavoring syrup in a soft drink dispenser, comprising:

a source of sweetener;

a source of water;

first means connected to said sources of sweetener and water for receiving sweetener and water and generating a sweetening syrup therefrom;

a source of flavoring agent; and second means interposed between said first means and said source of flavoring agent for combining said sweetening syrup and flavoring agent.

2. The system according to claim 1, wherein said sweetening syrup comprises a saturated solution of sweetener and water.

3. The system according to claim 2, wherein said first means comprises a first receptacle having first agitation means therein for mixing said sweetener and water to generate said saturated solution of sweetening syrup.

4. The system according to claim 3, wherein said first receptacle maintains a bottom level sensor for indicating a low level sweetening syrup within said first receptacle and a requirement for sugar and water to be added to said first receptacle.

5. The system according to claim 3, wherein said first receptacle maintains a top level sensor for indicating that said first receptacle has received sufficient sweetener and water for generating said sweetening syrup.

6. The system according to claim 5, further comprising control means interposed between said sources of sweetener and water for controlling entry of said sweetener and water into said first receptacle.

7. The system according to claim 6, wherein said first means further comprises a second receptacle having second agitation means therein for mixing said sweetener and water, a bottom level sensor for indicating a low level of sweetening syrup within said second receptacle and a top level sensor for indicating that said second receptacle has received sufficient sweetener and water for generating said sweetening syrup.

8. The system according to claim 7, wherein said second means comprises a dispensing head, and wherein said control means mutually exclusively operatively interconnects said first and second receptacles with said dispensing head.

9. The system according to claim 8, further comprising thermal sensing means interposed with said first and second receptacles and said control means, said control means determining a characteristic brix of said sweetening syrup as a function of a temperature of said sweetening syrup sensed by said thermal sensing means.

10. A method for dispensing a soft drink, comprising the steps of:

generating a sweetening syrup by dissolving sugar in water to obtain a saturated solution of sugar and water;

monitoring the temperature of said sweetening syrup;

dispensing said sweetening syrup;

dispensing a flavoring agent;

dispensing carbonated water; and combining said sweetening syrup, flavoring agent, and carbonated water.

11. The method for dispensing a soft drink according to claim 10, further comprising the step of dispensing said sweetening syrup as a function of said temperature of said sweetening syrup.

12. The method for dispensing a soft drink according to claim 11, further comprising the step of dispensing a quantity of said sweetening syrup as a function of said temperature of said sweetening syrup, said temperature being an indication of the brix of said sweetening syrup.

13. A method for dispensing a soft drink, comprising the steps of:

generating a sweetening syrup by dissolving sugar in water to obtain a saturated solution of sugar and water;

dispensing said sweetening syrup;

dispensing a flavoring agent;

dispensing carbonated water;

combining said sweetening syrup, flavoring agent, and carbonated water; and wherein said step of generating said sweetening syrup comprises the sub steps of depositing sugar and water in a receptacle and agitating said sugar and water to obtain said saturated solution, and further comprising a sub step of monitoring the dispensing of said sweetening syrup and engaging said sub steps of depositing sugar and water in said receptacle as a function of said monitoring.

14. A soft drink dispenser, comprising:

a dispensing head;

a source of carbonated water interconnected with said dispensing head;

means for generating unflavored syrup interconnected with said dispensing head, said means for generating unflavored syrup comprises a reservoir of water saturated with sugar in communication with said dispensing head, said reservoir comprising means for sensing particular levels of said water saturated with sugar and means for monitoring a temperature of said water saturated with sugar; and a source of flavoring in communication with said dispensing head.

15. The soft drink dispenser according to claim 14, further comprising means for regulating a quantity of said water saturated with sugar during a dispensing cycle as a function of said temperature.

16. The soft drink dispenser according to claim 15, further comprising means for controlling entry of water and sugar into said reservoir connected to said means for sensing said particular levels.

* * * * *